United States Patent [19]

Mueller

[11] Patent Number: 4,760,936

[45] Date of Patent: Aug. 2, 1988

[54] VENTABLE CONTAINER

[75] Inventor: Rolf J. Mueller, Simpsonville, S.C.

[73] Assignee: Textube Corporation, Greenville, S.C.

[21] Appl. No.: 40,648

[22] Filed: Apr. 21, 1987

[51] Int. Cl.[4] ..... B65D 51/16

[52] U.S. Cl. ..... 220/366

[58] Field of Search ..... 220/366, 367, 306; 215/307

[56] References Cited

U.S. PATENT DOCUMENTS 3,339,786 9/1967 Biglin ..... 220/366

*Primary Examiner*—George T. Hall

*Attorney, Agent, or Firm*—Dority & Manning

[57] ABSTRACT

A container comprising a wall structure defining an opening and an outwardly projecting bead extending peripherally about the opening is disclosed. A plurality of outwardly projecting vent ribs are provided on the bead. A closure which includes a cover member having a downwardly extending skirt is provided for sealing the container. The downwardly extending skirt has an inner peripheral surface which includes a curved member, for contacting the bead and the plurality of vent ribs, and also a tapered member extending downwardly from the curved member. Upon attachment of the cap to the container, the plurality of vent ribs allow for pressure to be released from the container over the bead and about the plurality of vent ribs, while allowing a sealing engagement of the cap with the closure to resume after relief of the pressure from the container.

4 Claims, 2 Drawing Sheets

Fig. 3.
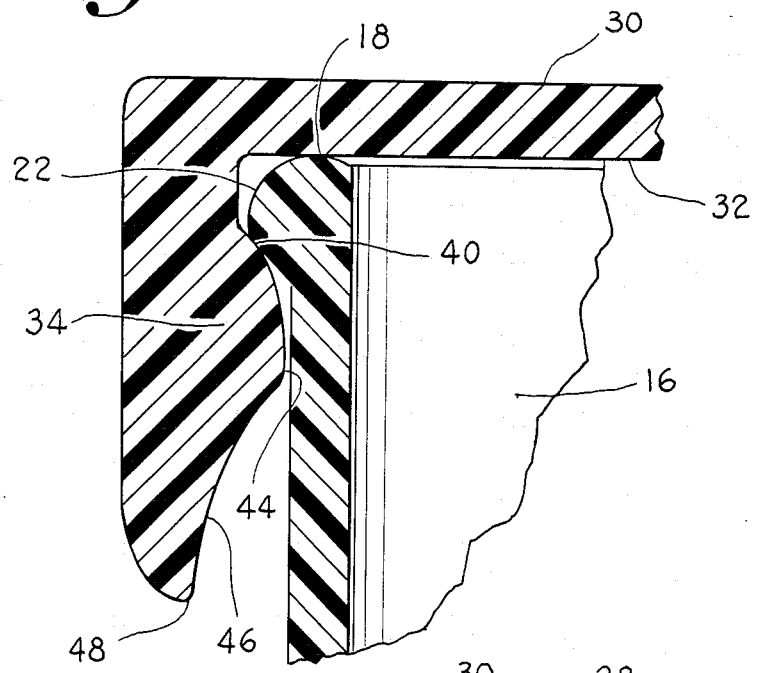
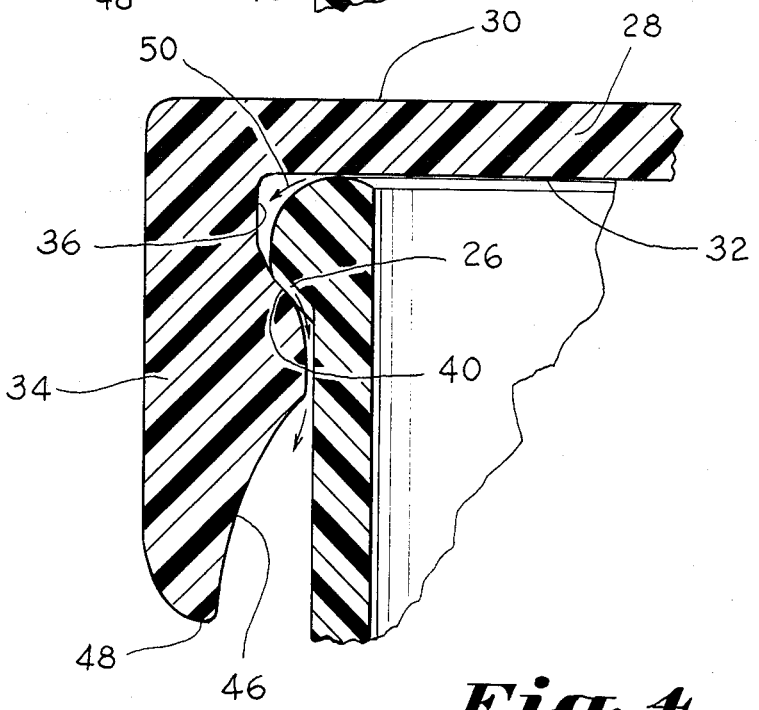
Fig. 4.

VENTABLE CONTAINER

BACKGROUND OF THE INVENTION

This invention relates to a container having a ventable seal which reseals itself after venting through the seal.

In certain container packaging operations, empty containers are first filled with a heated substance and then sealed. Subsequent to sealing of the container, gases may be released from the heated substance which causes pressure to build up in the container. The pressure may build up in the container to the point where the cap or lid which is used to seal the container actually pops off of the container, thereby unsealing the container. This is undesirable in that production is hampered due to the necessity of accommodating the containers which have become unsealed.

Snap-on caps are desirable for many sealing applications in that they may be readily attached to a container during production through a relatively simple pressing-type operation. Flexible, plastic caps have the advantage of being easily removable from the container and resealable on the container by the ultimate user or consumer. However, the phenomena of the container caps popping off of the container during the heating operation is especially troublesome on those containers having snap-on caps. One such container and cap configuration, manufactured by the applicant of the present invention, includes a snap-on cap having a circumferentially extending ridge provided on a downwardly extending skirt thereof. While such a container and cap configuration generally performs very well, when the container and cap are used for holding particular heated substances, the cap is prone to pop off of or become unsealed from the container. Also, the circumferentially extending ridge of the cap significantly limits the rate at which the containers can be sealed with the caps due to the abrupt profile of the ridge.

SUMMARY OF THE INVENTION

It is therefore an object of the present invention to provide a ventable container cap which may be intermittently vented to relieve pressure therein.

Another object of the present invention is to provide a ventable container having a closure which can easily be attached to and removed from the container.

Yet another object of the present invention is to provide a ventable container having a ventable seal which reseals the container after venting of the container.

Generally, one particular embodiment of the present invention includes a container comprising a wall structure defining an opening in the container. An upper peripheral surface is defined on the wall structure adjacent to the opening of the container. An outwardly projecting bead extends peripherally about the wall structure proximate the upper peripheral surface, the outwardly projecting bead having an outer surface adjacent the opening of the container. At least one vent rib is provided which is attached to the outer surface of the outwardly projecting bead, the at least one vent rib projecting outwardly therefrom. Also provided is a closure for substantially covering the opening of the container and an upper surface. A downwardly extending skirt is attached to the closure and has an inner peripheral surface. The inner peripheral surface cooperates with the outer surface of the outwardly projecting bead and the at least one vent rib to form a seal thereat for sealing the opening of the container. Upon a predetermined pressure being obtained in the container, pressure is relieved from the container about the at least one vent rib, between the outer surface of the outwardly projecting bead and the closure. The sealing engagement of the closure with the outer surface of the outwardly projecting bead is restored automatically after a predetermined relief of the pressure.

More specifically, the ventable container of the present invention may include a closure having an inner peripheral surface which defines a ring portion and a curved portion extending at an incline downwardly about the inner surface of the downwardly extending skirt, the curved portion being convexly curved away from the inner surface of the downwardly extending skirt, and the curved portion terminating at a predetermined position away from the ring portion. The closure may also include a tapered portion extending downwardly from the curved portion adjacent the predetermined position and about the inner periphery of the downwardly extending skirt, the tapered portion being inclined away from the curved portion and terminating at an edge of the downwardly extending rim. The curved portion and the tapered portion are configured such that upon attachment of the closure to the container, the upper peripheral surface of the container cooperates with the closure to form a seal thereat, and the curved portion cooperates with the outwardly projecting bead of the container to form a seal thereat.

BRIEF DESCRIPTION OF THE DRAWINGS

The foregoing as well as other objects of the present invention will be more apparent from the following detailed description of the preferred embodiment of the invention, when taken together with the accompanying drawings, in which:

FIG. 3 is a cross sectional view of a portion of the container of FIG. 1 taken along line 3—3; and FIG. 4 is a cross sectional view of a portion of the container of FIG. 1 taken along line 2—2.

DESCRIPTION OF THE PREFERRED EMBODIMENT

Figure 1:
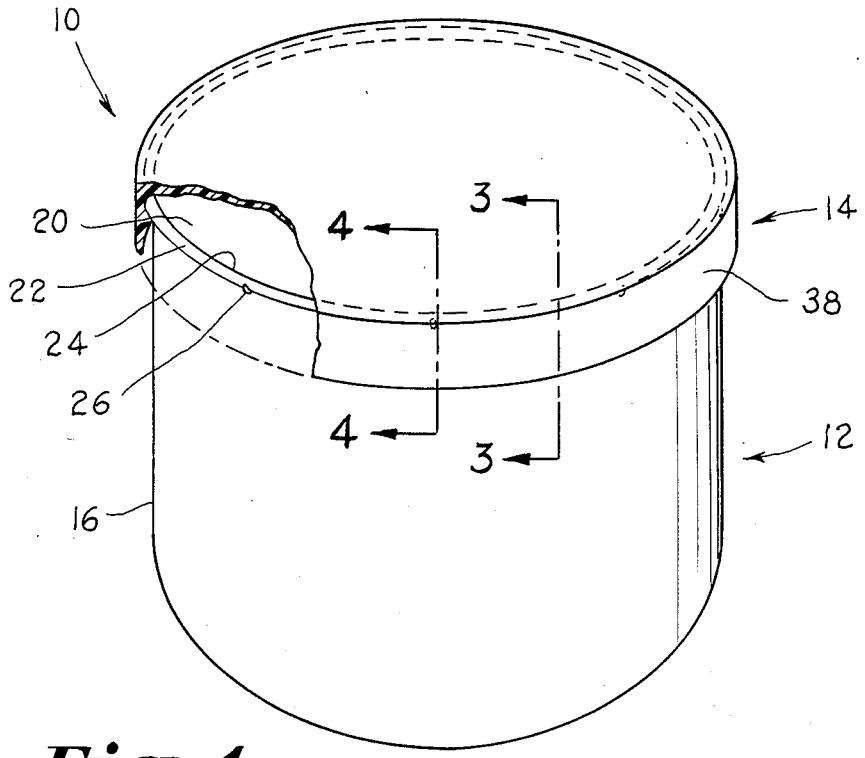
FIG. 1 is a perspective view of a preferred form of a ventable container constructed in accordance with the present invention.

Referring to the drawings in detail, wherein like reference characters represent like elements throughout the various views, the ventable container of the present invention is designated in FIG. 1 generally by the reference character 10. Ventable container 10 includes a receptacle, generally 12, and a closure or cap, generally 14.

Receptacle 12 includes a generally cylindrical wall structure 16 having an upper peripheral surface 18 defined thereon adjacent the opening 20 of the container. A bead 22 is located adjacent upper surface 18 of wall 16 and extends outwardly therefrom. Bead 22 extends peripherally about wall structure 16 and defines a portion of the sealing means for sealing container 10.

Figure 2:
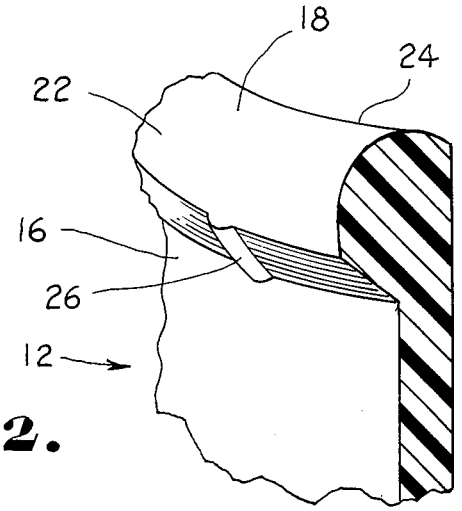
FIG. 2 is a perspective view, with parts cut away, of a container bead provided with a vent rib constructed in accordance with the present invention.

A plurality of vent ribs 26 are provided about the periphery of bead 22. As best shown in FIG. 2, each vent rib 26 is integral with bead 22 and extends outwardly therefrom. Vent ribs 26 extend substantially transverse to the periphery of bead 22 and are contactable with cap 14 upon sealing engagement of cap 14 with upper peripheral surface 18 and bead 22.

Cap 14 preferably includes a generally round, substantially planar cover member 28 having an upper surface 30 and a lower surface 32. Cover member 28 is configured and sized to completely cover opening 20 of receptacle 12. Downwardly extending from cover member 28 is a skirt 34 having an inner peripheral surface, adjacent cover member 28, and an outer surface 38. Defined on the inner peripheral surface of skirt 34 is a substantially vertical ring portion 36, spaced beneath lower surface 32 of cover member 28. A curved portion 40 extends beneath ring portion 36 at an incline downwardly about substantially the entire circumference of the inner peripheral surface of skirt 34. Curved portion 40 is curved away from ring portion 36 of skirt 34 and terminates at a predetermined position away from ring portion 36 at ridge member 44. Upon attachment of cap 14 to receptacle 12 through a snap-on, pressing motion of cap 14 against rim 24 of receptacle 12, upper peripheral surface 18 of receptacle 12 cooperates with lower surface 32 of cover member 28 to define a seal thereat, and curved portion 40 cooperates with bead 22 of receptacle 12 to define a seal thereat.

Extending downwardly from ridge member 44 is a tapered portion 46. Tapered portion 46 extends substantially about the entire circumference of the inner peripheral surface of skirt 34. Tapered portion 46 is inclined away from ridge member 44 and terminates at lower edge 48 of skirt 34.

After filling of receptacle 12 with a particular substance, such as a liquid or a gel, cap 14 is placed about bead 22 to cover opening 20 of receptacle 12. Upon placement of cap 14 about bead 22, a first seal is formed between receptacle 12 and cap 14 in that lower surface 32 of cover member 28 sealingly contacts upper peripheral surface 18 of receptacle 12. A second seal is formed between receptacle 12 and cap 14 in that curved portion 40 of cap 14 sealingly contacts bead 22 and the plurality of vent ribs 26 spaced therealong. The first and second seals together provide a fluid-tight tight sealing of receptacle 12.

Subsequent the filling of receptacle 12 and sealing with cap 14, ventable container 10 may be subjected to a heating operation for the heating of the substance carried therein or the container may be filled with hot material. In either case, vapors or gases may be generated which increase pressure within ventable container 10. Upon presence of a predetermined pressure within ventable container 10, the gases will tend to press upwards on lower surface 32 of cover member 28, causing lower surface 32 to become disengaged with peripheral surface 18 of rim 24. Upon this occurring, the gases may escape from the interior of ventable container 10 and pass over upper peripheral surface 18 and downwardly towards vent ribs 26. Vent ribs 26 allow for curved portion 40 to expand outwardly slightly from bead 22 to allow the gases to escape over bead 22 about vent ribs 26, as shown by arrows 50 in FIG. 4, while vent ribs 26 maintain frictional contact with curved portion 40 to retain cap 14 on receptacle 12. Upon cessation of expansion of the gases from receptacle 12, curved portion 40 of cap 14 will resume a normal sealing position in contact with bead 22, as shown in FIG. 3, and with vent ribs 26, and lower surface 22 of cover member 28 will resume sealing contact with upper peripheral surface 18, thereby again providing ventable container 10 with fluid-tight sealing.

FIG. 4 illustrates curved portion 40 contacting a vent rib 26, while FIG. 3 illustrates curved portion 40 contacting a portion of bead 22 between vent ribs 26.

Tapered portion 46 facilitates attachment of cap 14 about bead 22 due to the inclined, gradual transitional profile thereof. Tapered portion 46 allows for a much easier attachment of cap 14 to bead 22 than does the circumferentially extending ridge of the prior art cap discussed above, thereby allowing for improved production rates in the sealing of receptacle 12 with cap 14.

While ventable container 10 is illustrated as having a generally cylindrical receptacle 12 and a correspondingly round cap 14 therefor, it is to be understood that ventable container 10 could be of a variety of shapes and configurations, and that opening 20 and cap 14 are not to be limited to the generally round configuration as illustrated herein.

Both receptacle 12 and cap 14 are preferably constructed of an injection molded plastic such as polypropylene, although metal, paper, or other suitable materials could also be used, so long as it is capable, to construct ventable container 10.

While a preferred embodiment of the invention has been described using specific terms, such description is for illustrative purposes only, and it is to be understood that changes and variations may be made without departing from the spirit or scope of the following claims.

What is claimed is:

1. A container having a ventable cap which may be intermittently vented to relieve pressure within the container without loss of seal thereof, said container comprising:

an upper peripheral surface defined on said wall structure adjacent the opening of the container;

an outwardly projecting bead extending peripherally about said wall structure proximate said upper peripheral surface thereof, said outwardly projecting bead having an outer surface adjacent the opening of the container;

at least one vent rib attached to said outer surface of said outwardly projecting bead, said at least one vent rib projecting outwardly therefrom and extending substantially transverse thereto;

a closure, including:

a cover member for generally covering the opening of the container, said cover member having an upper surface and a lower surface, said lower surface cooperating with said upper peripheral surface for ventable sealing therewith; and a downwardly extending skirt attached to said cover member having an inner peripheral surface, said inner peripheral surface cooperating with both said outer surface of said outwardly projecting bead for ventable sealing therewith and said at least one vent rib for continuous frictional sealing thereat of said container opening; said ventable sealing and continuous frictional sealing comprising sealing means for allowing relief of pressure from the container upon a predetermined pressure being obtained therein about said at least one vent rib and between said outer surface of said outwardly projecting bead and the closure, while allowing resealing after venting with continuous maintenance of engagement of said outwardly projecting bead by said closure.

2. A container as defined in claim 1, wherein said closure further comprises said inner peripheral surface defining:

a ring portion;

a curved portion extending at an incline downwardly from about said ring portion of said downwardly extending skirt, said curved portion being convexly curved away from said ring portion of said downwardly extending skirt, said curved portion terminating at a predetermined position away from said ring portion; and a tapered portion extending downwardly from said curved portion adjacent said predetermined position and about said downwardly extending skirt, said tapered portion being inclined away from said curved portion, such that upon attachment of said closure to the container, said upper peripheral surface of the container cooperates with said lower surface of said cover member to form said ventable seal thereat and said curved portion cooperates with said outwardly projecting bead of the container to form said ventable seal thereat.

3. A container having an opening for receiving a closure in sealing, ventable contact therewith, the container comprising:

a wall structure defining the opening in the container;

an upper peripheral surface defined on said wall structure about the opening of the container, said upper peripheral surface cooperating with said closure to form a ventable seal therewith;

an outwardly projecting bead extending peripherally about said wall structure proximate said upper peripheral surface thereof, said outwardly projecting bead having an outer surface adjacent the opening of the container for ventable sealing engagement with the closure; and at least one vent rib attached to said outer surface of said outwardly projecting bead, said at least one vent rib projecting generally transversely and outwardly therefrom and being in generally continuous frictional sealing engagement with the closure upon ventable sealing engagement thereof with said outer surface of said outwardly projecting bead for allowing relief of pressure from the container about said at least one vent rib and between said outer surface of said outwardly projecting bead and the closure, while allowing resealing after venting with continuous maintenance of engagement of the closure with said outer surface of said outwardly projecting bead.

4. A container as defined in claim 3, wherein said wall structure is substantially cylindrical.

* * * * *